United States Patent [19]

Coff

[11] Patent Number: 4,844,282

[45] Date of Patent: Jul. 4, 1989

[54] CONTAINER FOR COMPACTED MATERIAL

[75] Inventor: Richard P. Coff, Wokingham, England

[73] Assignee: Soba (UK) Limited, Camberly, England

[21] Appl. No.: 143,414

[22] Filed: Jan. 13, 1988

[30] Foreign Application Priority Data

Jan. 13, 1987 [GB] United Kingdom ..... 8700727

[51] Int. Cl.[4] ..... B65F 1/00; B65F 1/10

[52] U.S. Cl. ..... 220/1 T; 414/420; 414/422; 100/229 A

[58] Field of Search ..... 220/1 T, 85 B; 414/406, 414/407, 408, 409, 420, 422; 100/229 A

[56] References Cited

U.S. PATENT DOCUMENTS

| | | | |
|---|---|---|---|
| D. 256,423 | 8/1980 | Bacskay et al. | 220/1 T |
| 1,238,010 | 8/1917 | Fisher | 220/1 T |
| 1,606,291 | 11/1926 | Burrows | 220/1 T |
| 3,773,197 | 11/1973 | Blakeley et al. | 414/409 |
| 3,910,434 | 10/1975 | Ebeling et al. | 414/408 |
| 4,138,025 | 2/1979 | Kennedy, Jr. | 414/420 |
| 4,427,333 | 1/1984 | Ebeling | 414/409 |
| 4,538,512 | 9/1985 | Blough | 100/229 A |
| 4,558,799 | 12/1985 | Hammond | 220/1 T |

*Primary Examiner*—David T. Fidei

*Attorney, Agent, or Firm*—Foley & Lardner, Schwartz, Jeffery, Schwaab, Mack, Blumenthal & Evans

[57] ABSTRACT

A container for receiving material to be compacted therein comprises a cylindrical body arranged with its longitudinal axis of symmetry vertical. The bottom is closed off and the top is closable by a lid. The material is introduced into the hollow body through a port in the peripheral wall of the body by a tube having an axis of symmetry which does not intersect the longitudinal axis of symmetry of the body.

3 Claims, 3 Drawing Sheets

CONTAINER FOR COMPACTED MATERIAL

BACKGROUND OF THE INVENTION

1. Field of the Invention

This invention relates to containers for compacted material.

2. Discussion of the Related Art

Containers for storing or transporting waste or raw materials are well known. Special containers are known into which waste or materials to be stored and/or transported are compacted to enable greater volumes of material to be handled with existing facilities. These known containers are usually rectangular in shape with one or more hinged lids and/or special openings to enable the material to be forced into the container and to be compacted therein. Subsequently the hinged lids are opened to enable the material to be removed from the container.

A difficulty which is encountered with known containers is that the material is forced into the container but, due to the shape of the container and the position of the opening through which the material is introduced into the container, the material does not take up all the available space in the container.

SUMMARY OF THE INVENTION

According to the present invention, a container for compacted material comprises a hollow cylindrical body with one end closed off and the other end closable by a lid; and a port in the peripheral wall of the body through which said material can be introduced into the body to be compacted therein, said port being arranged such that the axis of symmetry of the port in the direction into the body does not intersect the longitudinal axis of symmetry of the body.

In a preferred arrangement, the hollow body is arranged with its longitudinal axis of symmetry vertical and the lower end of the body is permanently closed off. The upper end of the body is closable by a two-part lid, with each part being hinged at its periphery to the cylindrical body.

The fact that the body is of cylindrical form, and the port has an axis of symmetry which does not intersect the longitudinal axis of symmetry of the body, means that material forced through the port into the body is given a movement which causes it to move around the vertical axis of symmetry of the body to completely fill the hollow cylindrical body with no voids being left in the cylindrical body.

The port conveniently includes a tube projecting outwardly from the cylindrical body and the outer end of the tube is adapted to be removably connected to a compacting machine. When the material is forced through the tube into the cylindrical body and is compacted therein, the maximum loads and forces occur in circumferential direction of the cylinder which is able to withstand greater stress levels without distortion than is the case of flat sided containers.

Furthermore, a cylindrical container where the length is not less than half the diameter or not greater than the diameter will always have a surface area less than the surface area of a rectangular container of the same volume and, consequently, will always be lighter for the same volume and strength.

BRIEF DESCRIPTION OF THE DRAWINGS

In order that the invention may be more readily understood, it will now be described, by way of example only, with reference to the accompanying drawings, in which.

DETAILED DESCRIPTION OF THE INVENTION

Figure 1:
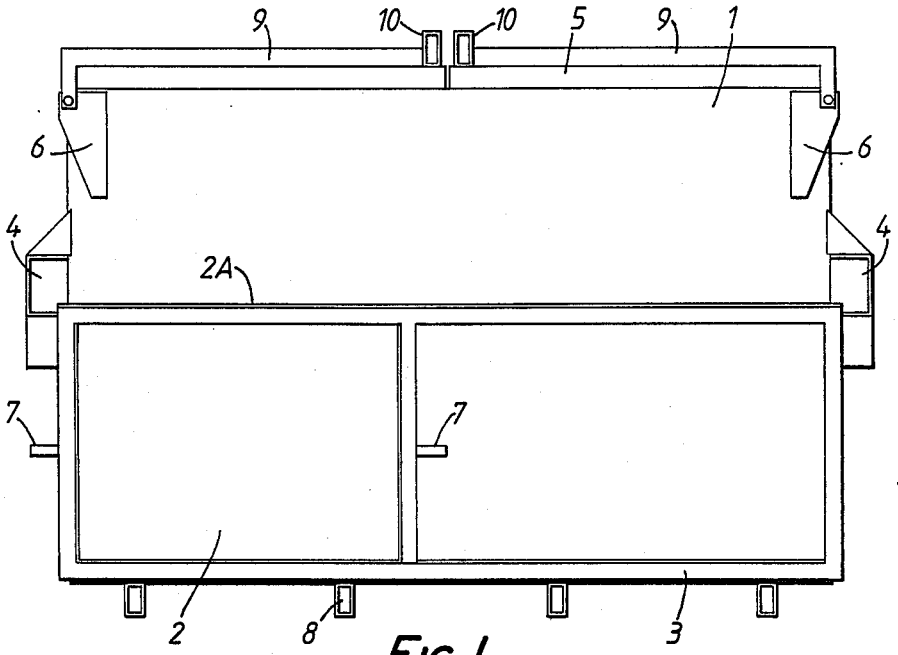
FIG. 1 is a front elevation of the container.
Figure 2:
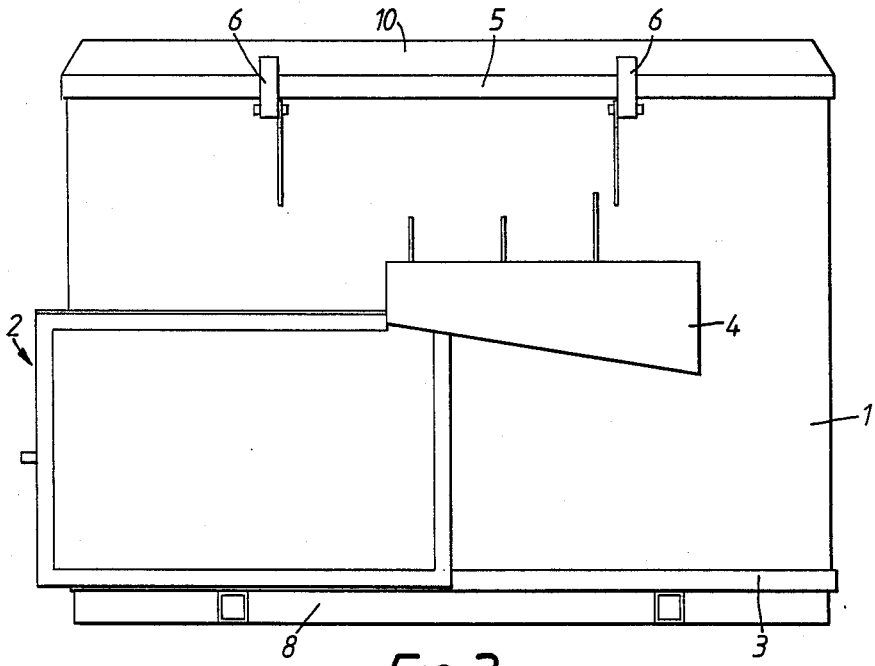
FIG. 2 is a side elevation.
Figure 3:
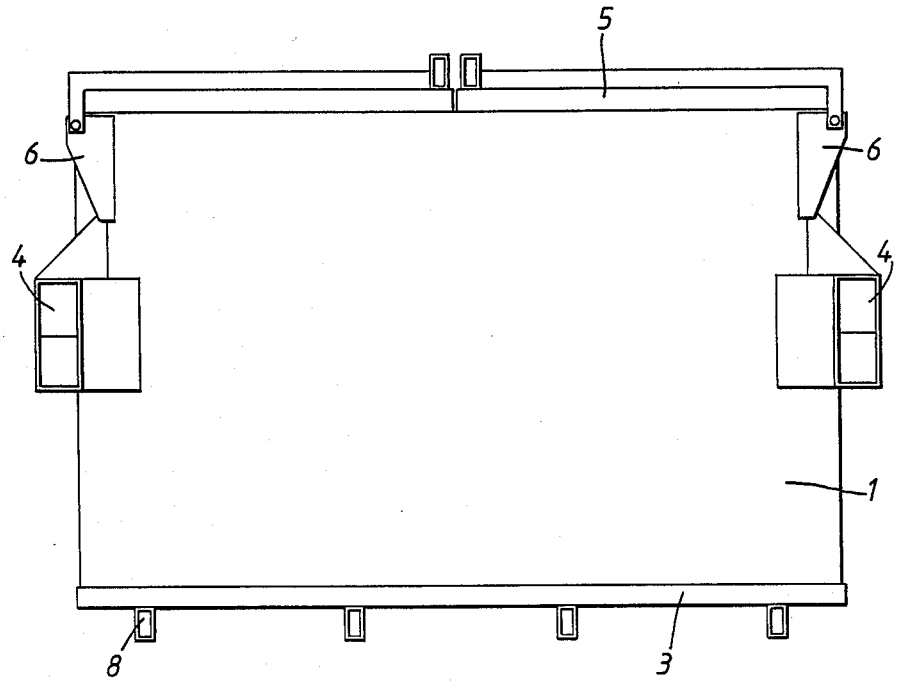
FIG. 3 is a rear view.
Figure 4:
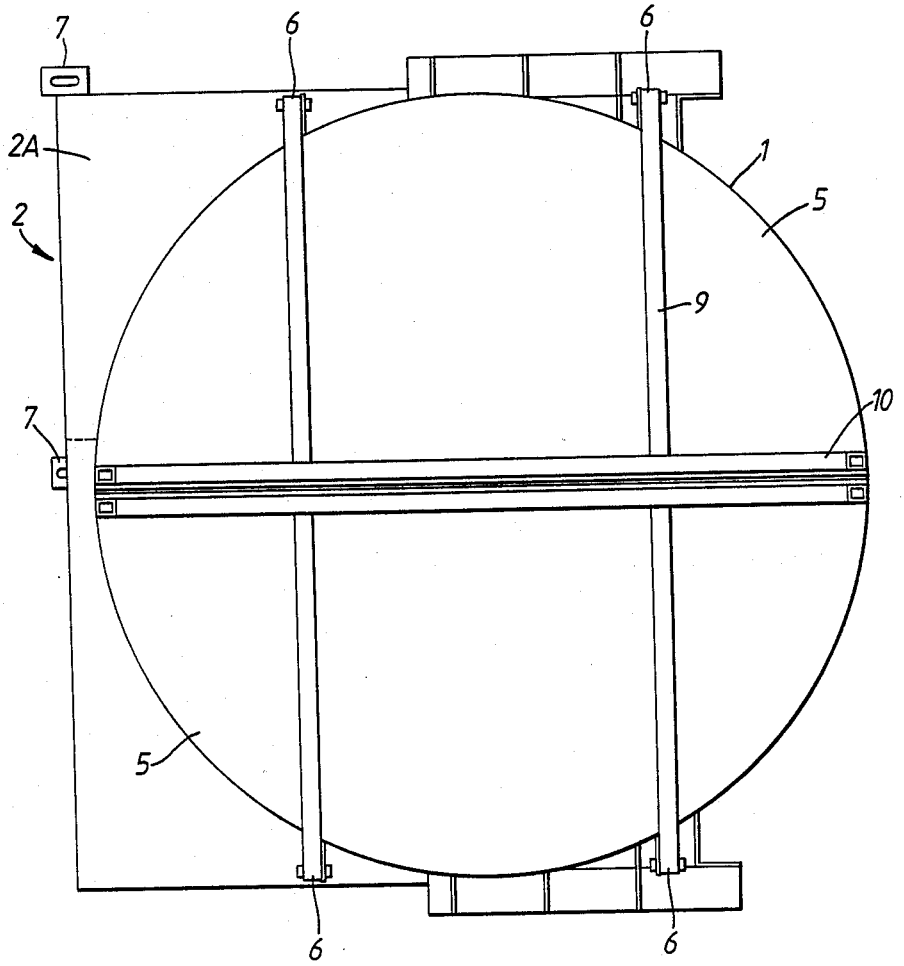
FIG. 4 is a plan.

Referring to the drawings, a container for compacted material comprises a hollow cylindrical metal body 1 arranged with its longitudinal axis of symmetry vertical. The lower end of the body is permanently closed off by a bottom wall 3 which is stiffened by a number of hollow supports 8 secured to its outer surface. The upper end of the body is provided with a two-part lid with each part 5 being hinged to the cylindrical body on hinge brackets 6. Each part of the lid is stiffened by elongate stiffening bars 9, 10 and, when the lids are in the closed position, they can be secured to the body by means of bolts, padlocks or the like.

In order to readily move the container, a pair of sockets 4 are secured to respective opposite sides of the body and they serve to receive the arms on the lifting platform of a fork lift truck or the like.

In order to be able to introduce material into the container and to ensure that the container is uniformly filled with the material, an opening port 2 is provided in the peripheral wall of the body. This port has a portion 2A in the form of a tube of square cross-section leading to an opening in the wall of the body. At the outer end of the tube, coupling means 7 enable the outlet of a compactor machine (not shown) to be coupled to the tube. The axis of symmetry of the port in the direction leading into the body does not intersect the longitudinal axis of the body. As shown in the figures, the axis of symmetry of the port is offset from the longitudinal axis of symmetry of the container.

Material supplied to the compacting machine is forced along the tube and through the peripheral wall of the body into the interior of the body. The material engages the inner side wall of the body and is caused to move with a swirling action in the container, thus filling all the available space in the container. As more material is forced into the container it becomes compacted.

When the container is completely filled, the compacting machine is removed from the end of the tube and a plate (not shown) is fastened across the mouth of the port. The container is subsequently moved to a new location and the material is removed from the container through the open upper end after the lids 5 have been opened.

In the arrangement shown in the figures, the tube 2A leading to the opening in the peripheral wall of the container is at a low level in the side wall whereas, in an alternative arrangement, it could be provided near the upper end of the cylindrical body.

I claim:

1. A container for compacted material comprising:

a hollow cylindrical body arranged with its longitudinal axis of symmetry vertical, said body having a peripheral side wall, a bottom wall and an open top;

a lid hinged to the body and arranged in one position to close the open top; and a tube extending outwardly from the peripheral wall of the body, said tube surrounding an opening in the peripheral wall of the body, the longitudinal axis of symmetry of the tube being arranged such that it does not intersect the longitudinal axis of symmetry of the body, the end of the tube away from the body being adapted for connection to the outlet of a compactor whereby material from the compactor is introduced into the body through the tube and said opening.

2. A container as claimed in claim 1 in which the lid comprises two co-operating parts each of which is hinged to the side wall of the body.

3. A container as claimed in claim 1 in which said tube is of square cross section.

* * * * *